US005924158A

United States Patent [19]

Watts

[11] Patent Number: 5,924,158

[45] Date of Patent: Jul. 20, 1999

[54] PIPELINE PIG

[76] Inventor: Robert C Watts, 7889-48 Ave, Red Deer, Alberta, Canada, T4P 2H6

[21] Appl. No.: 09/096,017

[22] Filed: Jun. 8, 1998

Related U.S. Application Data

[63] Continuation-in-part of application No. 08/807,220, Feb. 28, 1997, abandoned, which is a continuation-in-part of application No. 08/262,579, Jun. 20, 1994, abandoned.

[51] Int. Cl.[6] ..... B08B 9/04

[52] U.S. Cl. ..... 15/104.061

[58] Field of Search ..... 15/104.061, 104.062, 15/104.063, 3.5, 3.51, 3.52; 134/8

[56] References Cited

U.S. PATENT DOCUMENTS

| | | | |
|---|---|---|---|
| 646,545 | 4/1900 | Novotny | 15/104.061 |
| 2,764,565 | 9/1956 | Hoppe et al. | 260/25 |
| 3,011,197 | 12/1961 | Nehse | 15/104.06 |
| 3,543,323 | 12/1970 | Girard | 15/104.06 |
| 3,651,530 | 3/1972 | Schultz | 15/104.06 R |
| 3,863,287 | 2/1975 | Knapp et al. | 15/104.061 |
| 4,242,771 | 1/1981 | Knapp | 15/104.06 R |
| 4,244,073 | 1/1981 | Sagawa | 15/104.06 |
| 4,406,031 | 9/1983 | Eimer et al. | 15/104.06 R |
| 5,150,493 | 9/1992 | Sivaco | 15/104.061 |

FOREIGN PATENT DOCUMENTS

| | | |
|---|---|---|
| 13193 | 2/1900 | Germany . |
| 869860 | 10/1981 | U.S.S.R. . |
| 913014 | 3/1982 | U.S.S.R. . |

*Primary Examiner*—Gary K. Graham
*Attorney, Agent, or Firm*—David S. Thompson

[57] ABSTRACT

A pipeline pig suitable for use in cleaning deposits and buildup from an interior surface in a pipeline is also particularly suited for applications wherein the pipeline has a series of bends, right angles or even plug headers. The pig is suitable for bidirectional travel, having front and rear hemispherical noses. The pig is constructed in a manner that facilitates a greater degree of elongation and deformation than is possible with known pipeline pigs, while still providing the radially outward bias that is required to effectively scrape the sidewalls of the pipeline. A cover carries a plurality of metal studs arrayed about the cylindrical middle portion, and encloses an internal core. The core is formed in a mold from a mixture of resin and ISO, resulting in a pig having superior ability to elongate and deform, if needed, while still effectively scraping the sidewalls of the pipeline.

1 Claim, 4 Drawing Sheets

PIPELINE PIG

CROSS-REFERENCES

The present application is a continuation in part of application Ser. No. 08/807,220, filed Feb. 28, 1997, now abandoned. The Ser. No. 08/807,220 application was a continuation in part of application Ser. No. 08/262,579 filed Jun. 20, 1994, previously abandoned. The Ser. No. 08/807,220 and 08/262,579 applications are hereby incorporated herein by this reference.

BACKGROUND

Over time the fluid carried within a pipe tends to coat the inner walls of the pipe. This coating reduces the cross-sectional area of the interior of the pipe, and reduces the fluid flow. The problem is particularly acute in fired heaters used in oil refineries which cause the crude oil to be heated for the purpose of fractionating the oil into its various components. This process results in impurities attaching to the inside of pipes used in such fired heaters.

A standard method of cleaning pipelines and piping within fired heaters in the oil and gas industry is to drive a pipeline pig through the pipe using fluid pressure. Friction between the exterior of the pipeline pig and the interior surface of the pipe cleans and removes buildup from the pipe.

A typical problem with most pipe pigs is that they are unidirectional, i.e. they are suited for travel in only one direction. As a result, it is not possible to run the pipeline pig back and forth through a limited length of pipe for extra cleaning; the entire pipe must therefore be recleaned. A few pipe pigs are spherical, and therefore suited for travel in any direction, but as a result of their shape have very little surface area to frictionally engage the interior surface of the pipe.

A further problem common to most pipeline pigs is that they do not navigate about bends and corners very well, and the potential for entrapping a pipeline pig within the pipe is quite high.

A still further problem common to most pipeline pigs is that where outwardly directed studs are required to provide the abrasion necessary to clean the inside of a pipeline or piping within a fired heater, there is stress between the pipeline pig and the studs. In time, the stress may cause damage to the pipeline pig, possibly causing tears on the surface of the pipeline pig, adjacent to the outwardly protruding studs. In more extreme cases, the stud may be stripped from the surface of the pipeline pig and lost.

For the foregoing reasons, there is a need for a pipeline pig that can be operated in either direction, that is rugged and durable, having an improved connection between the pipeline pig and any supported studs, and that is suitable for navigating around corners and bends in pipelines.

SUMMARY

The pipeline pig of the present invention provides some or all of the following structures.

(A) A bidirectional body, suitable for travel in either direction within a pipeline, having a plane of symmetry perpendicular to the length of the pig. Forward and backward facing noses are generally bluntly shaped. A cylindrical middle portion of the body is adapted to provide sufficient surface area to seal against the inside surface of the pipeline, thereby allowing effective removal of buildup from that surface.

(B) A foam core is somewhat elongatable and compressible, and facilitates the deformation needed to allow the pig to negotiate corners and plug headers. The foam core, properly constructed, causes the body of the pig to elongate in restricted areas of the pipe where buildup is greater, and where needed to negotiate past plug headers. In an example of a pig constructed in accordance with the preferred embodiment, a mixture of 130 grams of resin and 120–124 grams of ISO is required for a pig having a 4 inch diameter. The resin and ISO combine to form a core having a superior combination of the ability to bias the external cover and associated studs against the interior surface of the pipe while also allowing the pig to elongate, where required to negotiate corners associated with plug headers and areas of greater buildup within the pipe.

(C) An external cover having holes drilled for the support of a plurality of studs, particularly arrayed over the middle portion of the body. In the preferred embodiment, the external cover is made of Uniroyal chemical VIBRATHANE 8083, which is abrasion resistant, sufficiently rigid to hold the studs in place and yet flexible enough to allow the pig to elongate to negotiate corners associated with the plug headers.

(D) A plurality of studs, carried by the cover, form an abrasive surface which scrapes the buildup from the sidewalls of the pipe. The studs are attached to the external cover in a manner that will not allow their release. In a variation of the invention, the holes defined in the external cover are sized to allow insertion of the studs only after some inflation of the external cover. Compressed air may be used to temporarily inflate the external cover, thereby increasing the diameter of the drilled holes to a degree that studs may be inserted. When the external cover is deflated, the cover provides a greater force directed radially inwardly at the stud than would have been possible without inflation of the external cover.

It is therefore a primary advantage of the present invention to provide a novel pipeline pig having a superior ability to negotiate curves, corners, plug headers and areas of extreme buildup within a pipeline or piping within a fired heater, and which still provides adequate biasing pressure against the interior sidewalls of the pipeline to be cleaned.

Another advantage of the present invention is to provide a pipeline pig that has a plurality of studs carried by the external cover, where each stud is carried by a hole defined in the cover that is drilled prior to stud insertion, and particularly where the diameter of the hole is sized for insertion of the stud only after some inflation of the external cover.

Another advantage of the present invention is to provide a pipeline pig having a somewhat rigid and very abrasion-resistant cover having the strength to adequately anchor a plurality of studs in a non-releasable manner, yet also provides a flexible core to allow the pig to maneuver within a non-linear pipeline.

A still further advantage of the present invention is to provide a pipe pig that is suitable for use in a bidirectional manner, i.e. a pipe pig that can be operated in either direction within the pipe.

DRAWINGS

These and other features, aspects, and advantages of the present invention will become better understood with regard to the following description, appended claims, and accompanying drawings where:

DESCRIPTION

Figure 1:
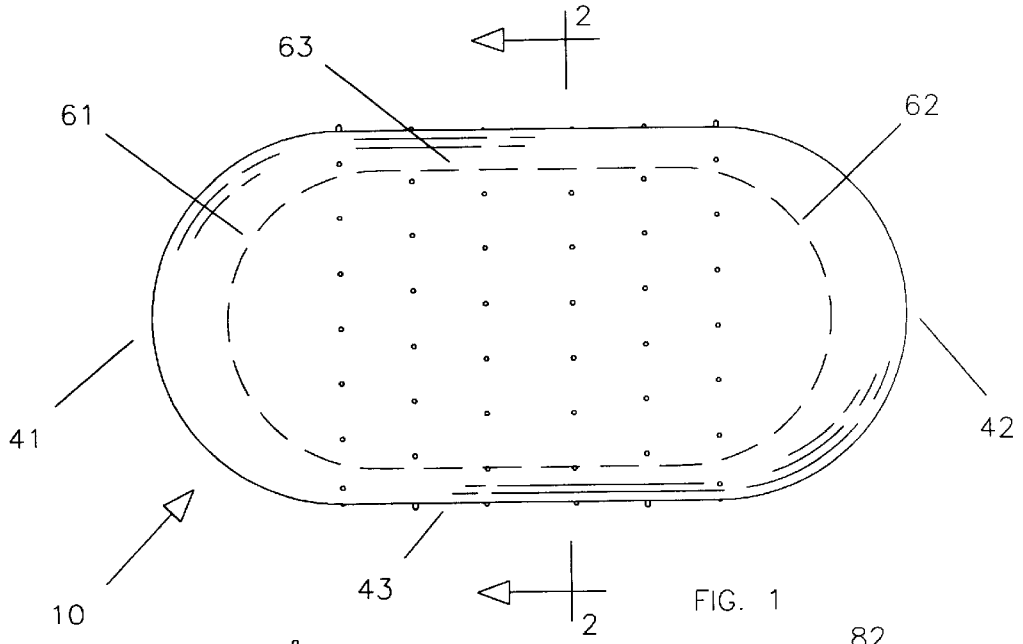
FIG. 1 is a side orthographic view of a pipe pig constructed in accordance with the principles of the invention, having the core shown in dotted outline.

Referring in generally to FIGS. 1 through 8, a pipeline pig 20 constructed in accordance with the principles of the invention is seen. A bidirectional body is formed from a core 60 that is optionally encased by a cover 40, which may optionally support a plurality of studs 80, typically arrayed about the cylindrical middle portion of the pig. The body is bidirectional in the sense that a plane of symmetry exists which is perpendicular to the length of the pig and the direction of the pig's travel within a pipeline or plug header 105.

Significantly, the bidirectional pig is not spherical. A spherical pig generally provides too little surface area in contact with the sidewalls of the interior of the pipe, and is therefore a less efficient cleaning tool. The pipeline pig 20 provides a cover having a cylindrical middle portion 43 and a core having a similar cylindrical portion 63. The cylindrical nature of the middle portion of the pig 20 allows sufficient contact with the interior surface 103 of a pipe 100 to adequately remove buildup 104.

Figure 5:
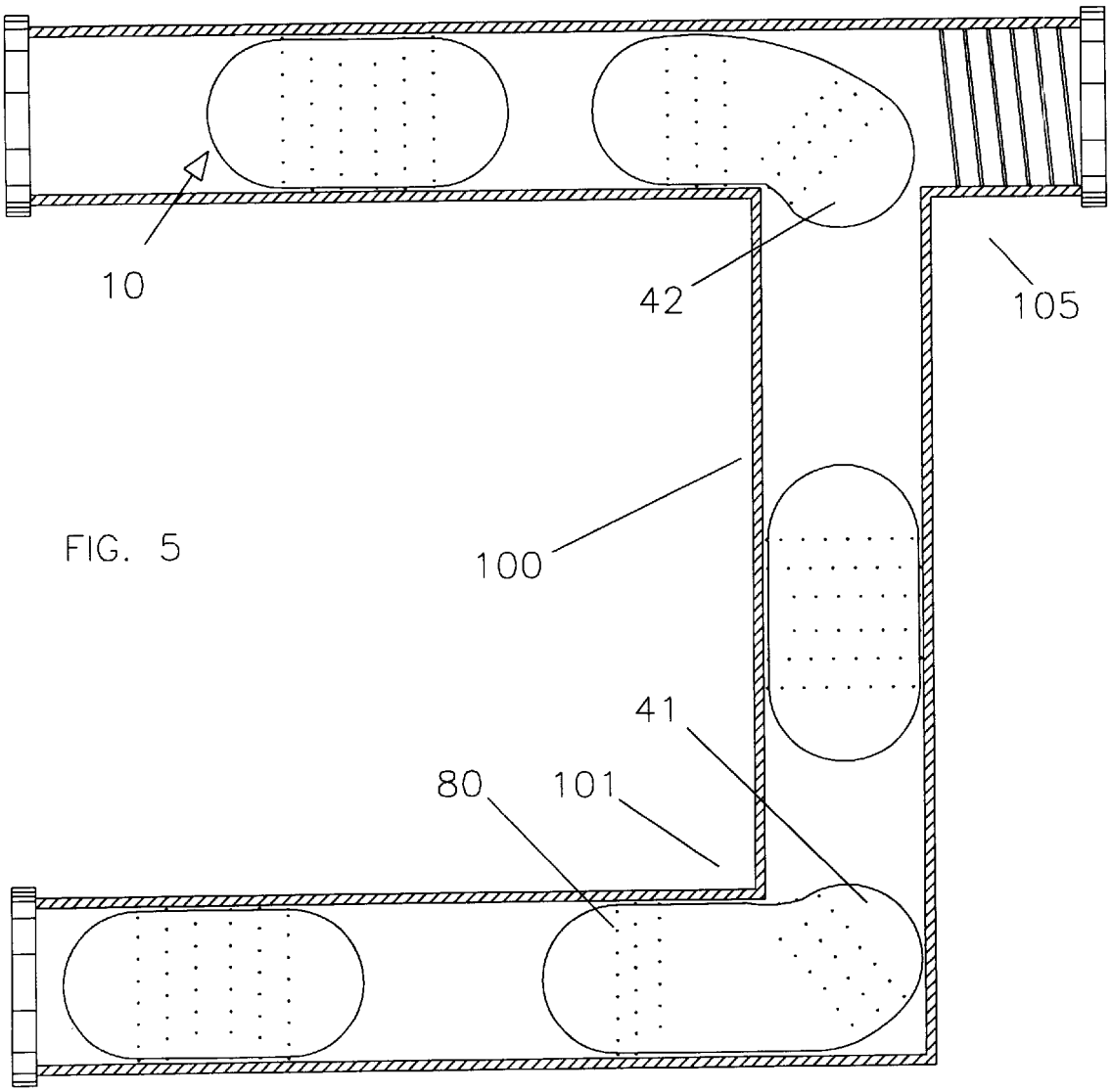
FIG. 5 is a view of a pipeline pig moving through a pipe having a series of right-angle turns.

Bluntly shaped forward and backward facing hemispherical noses are well suited to interact with the interior of a pipeline to reorient the pig 20 as it moves through bends, curves and 90 degree turns within the pipeline. As the pig moves through straight sections of a pipeline, the cylindrical middle portions of the cover and core of the body are adjacent to the inside walls 103 of the pipeline, and are adapted to provide surface area to seal against and frictionally engage the inside surface of the pipeline, thereby removing buildup 104. As seen in FIG. 5, when the pig encounters a curve 102, bend or right angle turn 101, the front hemispherical nose contacts the interior surface 103 and applies an unsymmetrical force on the pig, causing it to turn.

As seen in FIG. 1, the core 60 provides front and rear hemispherical noses 61, 62, and a cylindrical middle portion 63. The core is typically of solid, rather than hollow construction, and is made of a material that allows the core to have the flexibility required to navigate curves and corners in pipelines. The flexibility should allow the core to elongate, compress and bend in response to external forces.

In a preferred version of the invention, a core suitable for use in producing an approximately 4" pig suitable for use in a 4" pipeline is manufactured as follows. First, resin is mixed for approximately 15 minutes. A preferred type of resin is BASF product number 2258242, although certain other resin products may be substituted. Second, ISO (isocyanate, also known as polymethylene or polyphenylisocyanate) is mixed for another 15 minutes. A preferred ISO is BASF product number 225841, although certain other ISO products may be substituted. Third, 130 grams of resin and 120–124 grams of ISO are mixed together for 4 minutes and then poured into a mold. The mold is then closed for a period of 10 minutes, after which the core is complete.

A compressible, flexible and elongatable core may be used alone as an economical pipe pig, or in conjunction with a cover to form a superior pipe pig having greater durability and a more abrasive surface which may be more effective in removing buildup 104 from the interior surface 103 of the pipeline 100.

Figure 2:
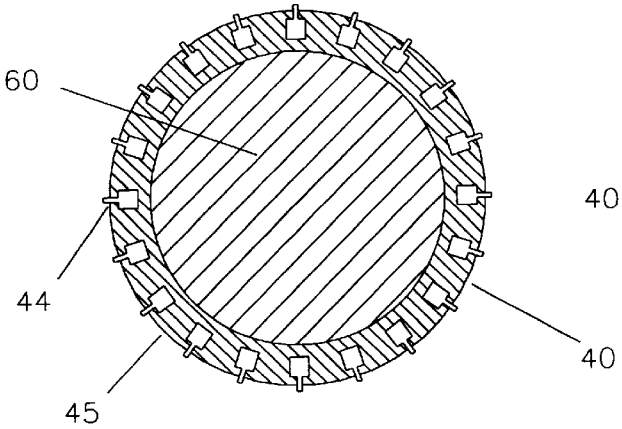
FIG. 2 is cross-sectional view of the pipe pig of FIG. 1, taken about the 2—2 lines.

As seen in FIG. 2, the cover provides front and rear hemispherical noses 41, 42 and a cylindrical middle portion 43 that makes contact with the interior surface of a pipeline to be cleaned. A preferred version of the external cover 40 of the invention is made with urethane, or more specifically, Uniroyal chemical Vibrathane 8083. FIG. 2 illustrates in cross-section the relationship of the cover 40 to the studs 80 and the core 60. A mold supporting wire rods passing through the core is used to produce the cover. Such a mold allows the core to be supported in a manner that results in a cover that is of uniform thickness, typically ½".

With the core supported in the mold, the urethane is then poured into the mold. The mold is then heated to 250 degrees. The pig is then removed from the mold and placed in a curing oven for approximately 2 hours.

A plurality of holes 44 may be drilled in the surface 45 of the pig. The holes are generally 1/16 inch in diameter. Typically, the holes are drilled in a regular array, as seen in FIG. 1, about the cylindrical middle portion 43. In one version of the invention, the holes should be slightly smaller than the actual size of the studs to be used, which are typically snow tire or similar studs.

The pig is then heated again to 250 degrees. After the pig reaches this temperature, studs are inserted with an air gun, in a manner similar to the way in which tire studs are inserted into a snow tire.

Figure 3:
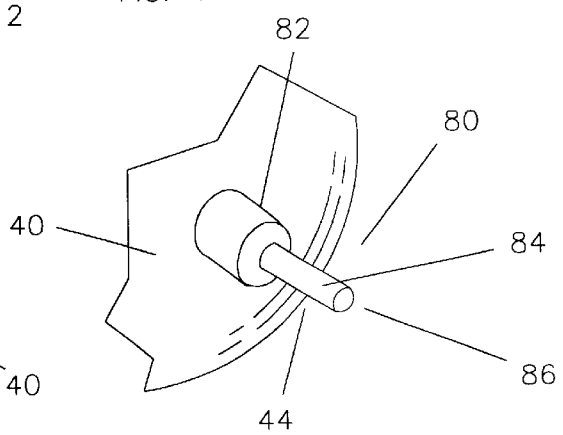
FIG. 3 is an enlarged view of one of the studs carried by the cover, wherein the stud is visible through the cover material, to better disclose the structure of the stud.
Figure 4:
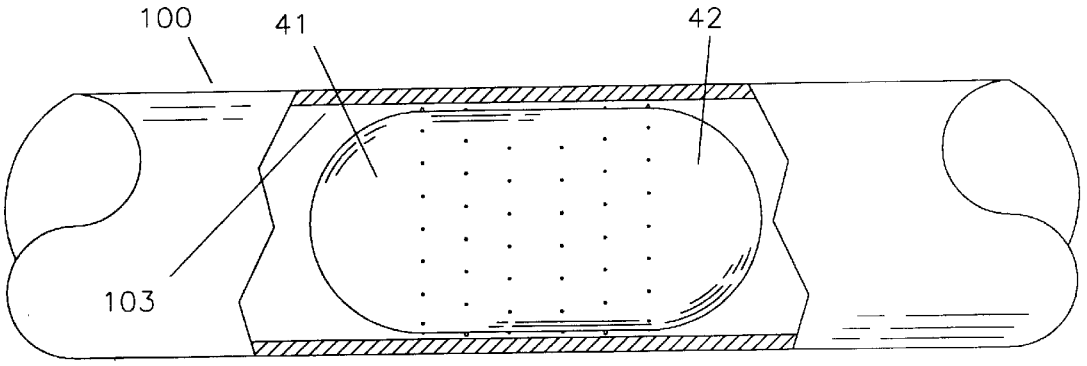
FIG. 4 is a view of the pipe pig of FIG. 1 in a partial cross-sectional view of a pipe.

As seen particularly in FIGS. 2 and 3, a plurality of studs 80, each stud carried by a drilled hole, form an abrasive surface usable to scrape the buildup from the sidewalls of a pipe. In the preferred version of the invention, each stud provides a cylindrical casing 82 which carries within it a rod 84 which extends in an axial manner from the casing. In the preferred version, the tips 86 of the studs extend 1/16" past the external surface 45 of the urethane cover 40.

In a preferred version of the invention, tire studs, or a similar stud are used. Such studs are typically made from a casing of a first, typically less expensive metal, and a rod made of a second, typically more expensive metal. For example, the casing or base may be made of a less expensive metal selected from the group consisting of aluminum, copper, iron, an alloy of aluminum, an alloy of copper and an alloy of iron.

The rod is made of a very hard, and typically expensive, metal. For example, the material from which the rod may be made may be selected from the group consisting of tungsten carbide, iron carbide, an alloy of tungsten carbide and an alloy of iron carbide, or other similar very hard metals. Material selected from this group is generally unnecessarily expensive for use in constructing the entire stud, and is best used on the rod only, where frictional forces with the interior of the pipeline require a durable surface.

In a practical matter, typical tire studs generally provide a base that is made of a much less expensive alloy or metal such as aluminum, copper or iron, and a rod that may be made of tungsten carbide or iron carbide. As a result, such tire studs may be an economical choice for use in the construction of the pipeline pig. The construction of such tire studs typically provides a casing or base that is compressed radially inwardly about the rod, deforming the casing plastically, and thereby clinching the rod in a manner that provides a non-releasable connection.

In a preferred version of the Applicant's pipe pig, the studs are attached to the cover with an air gun in an automated manner, similar to the formation of studded snow tires. Holes 44 having a diameter of 1/32 inch are drilled into the cover of the pig. These holes are substantially smaller than the 1/16 inch holes drilled where air inflation of the pig is not used. As a result, when the cover is deflated, the cover tends to grip the studs more vigorously.

The cover is heated as described above, and as seen in FIG. 7, an air inflation needle 120 is inserted into the pipeline pig, to a depth equal to the thickness of the cover 40. The cover is inflated, enlarging it somewhat, and thereby temporarily increasing the diameter of the holes 44. An air gun is then used, in the manner described above, to insert the studs.

Figure 8:
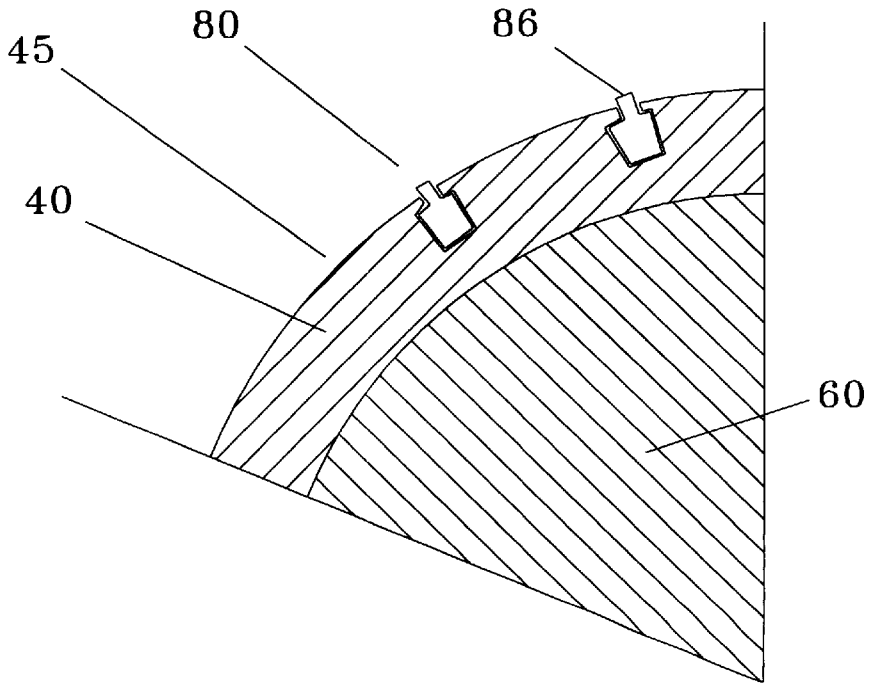
FIG. 8 is a view of the cover after the cover has been deflated and the stud inserted.

The cover is then deflated, as seen in FIG. 8, causing the studs to be securely held by holes 44 defined in the cover.

The bidirectional pipeline pig of the invention is used by inserting the pig into the pipeline, typically using a pig launcher at one end of the pipeline. Fluid is used to force the pig through the pipeline. The cylindrical middle portion 43 of the cover 40 of the pig 20 and array of studs 80 make frictional contact with the interior surface of the pipeline and remove and clean that surface of waste, buildup and debris 104.

The pipeline pig 20 is well-suited for negotiating corners within the pipeline. This is important, since without this ability, many pipelines and fired heaters (cokers and visbreakers) could not be cleaned economically. The ability to negotiate corners is due in part to the interaction between the shape of the pig and the interior surface of the pipe. The front and rear semi-spherical noses 41, 42 of the cover 40 are shaped in a manner that will cause the pig to turn or bend when a side of the nose hits a curve 102 or 90 degree bend 101 in the pipeline.

Figure 6:
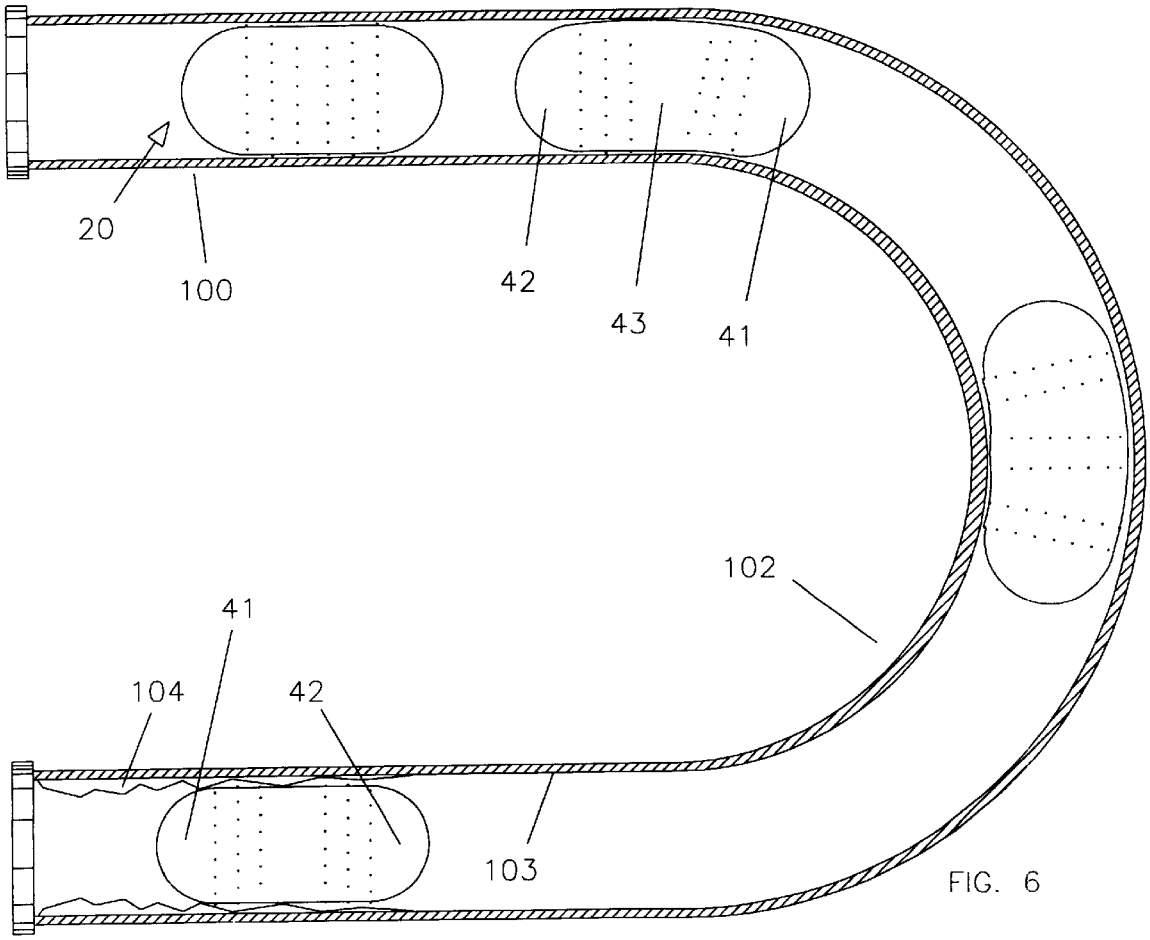
FIG. 6 is a view of a pipeline pig elongating in response to pipe having a rounded corner.
Figure 7:
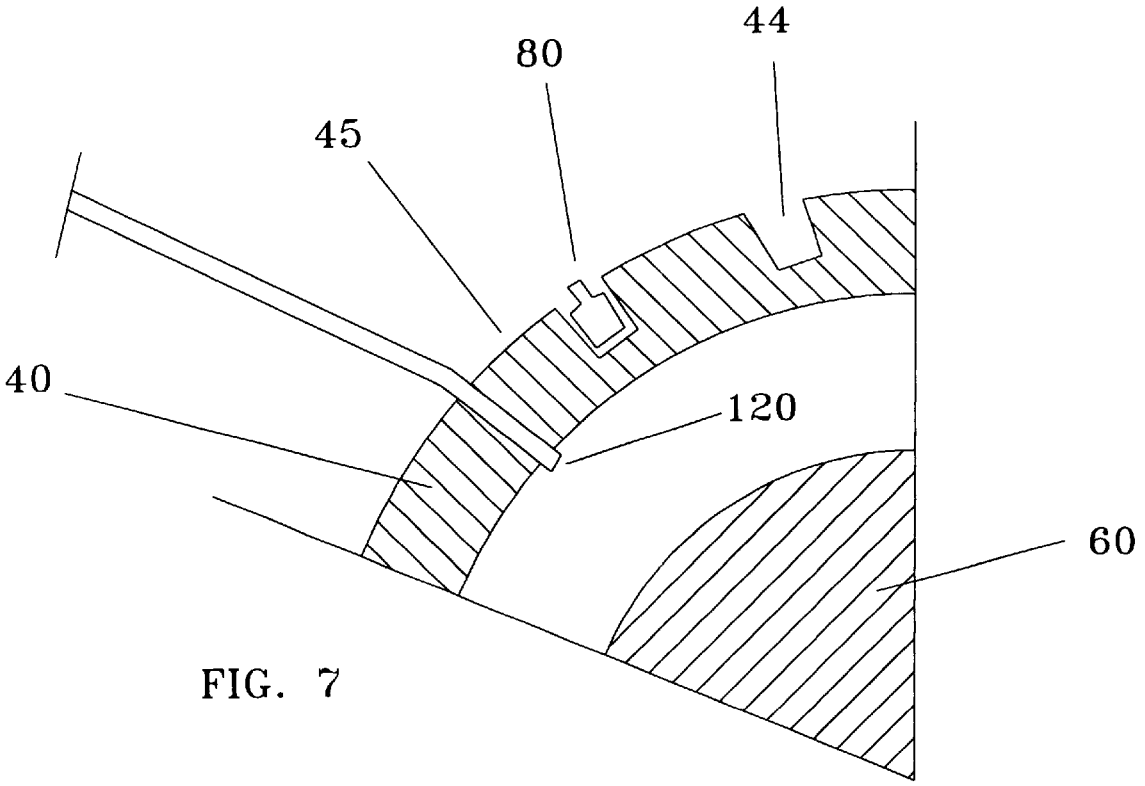
FIG. 7 is a view of the cover having been somewhat inflated, the air inflation needle, and showing one stud having been inserted in a first hole, and showing a second hole, enlarged by the inflation, ready to receive a stud.

FIGS. 5 and 6 illustrate a pipeline pig 20 bending and elongating as the pipeline pig moves around curves and bends in a pipeline 100. As seen in FIG. 5, when one side of the nose 41 of the front cover hits the side of the pipe due to a bend or corner, the pig tends to move in the opposite direction, thereby negotiating the bend or corner. Referring particularly to FIG. 6, when one side of the nose contacts a curve in the pipeline, the pig bends somewhat in response, and the nose begins to point away from the obstruction, thereby turning the pig.

Another factor contributing to the pig's ability to negotiate bends and corners involves the nature of the material used to form the core 60 of the pig 20, which tends to elongate and narrow as the pig moves through bends, curves, corners and areas of heavy buildup. As the pipeline pig moves, it directs force radially against the inside walls of the pipeline or plug heater, which tends to scrape and dislodge build up 104, thereby cleaning the pipeline.

The pipeline pig may be operated with pig launcher on each end of the pipeline, thereby allowing the pig to be reversed, if desired, to pass again through sections of pipe that are particularly narrowed by buildup. Generally, when the pressure of the fluid driving the pig drops, it is an indication that the pig is moving more rapidly due to lessened friction, and has just left an area of greater buildup. The direction of the pig may then be reversed by use of the alternate pig launcher, thereby causing it to travel again through the area of greater buildup. This is more efficient that redoing the entire pipeline, and is made possible by the bidirectional shape of the pig 20.

The previously described versions of the present invention have many advantages, including a primary advantage of the providing a novel pipeline pig having a superior ability to negotiate curves, corners and areas of extreme buildup within a pipeline, and which still provides adequate biasing pressure against the interior sidewalls of the pipeline to be cleaned.

Another advantage of the present invention is to provide a pipeline pig that has a plurality of studs carried by the external cover, where each stud is carried by a hole defined in the cover that is drilled prior to stud insertion, and particularly where the diameter of the hole is sized for insertion of the stud only after some inflation of the external cover.

Another advantage of the present invention is to provide a pipeline pig having a somewhat rigid and very abrasion-resistant cover having the strength to adequately anchor a plurality of studs in a non-releasable manner, yet also provides a flexible core to allow the pig to maneuver within a non-linear pipeline.

A still further advantage of the present invention is to provide a pipe pig that is suitable for use in a bidirectional manner, i.e. a pipe pig that can be operated in either direction within the pipe.

The invention resides not in any one of the above features per se, but rather in the particular combination of all of them herein disclosed and claimed and is distinguished from the prior art in this particular combination of all of its structures for the functions specified.

Although the present invention has been described in considerable detail and with reference to certain preferred versions, other versions are possible. For example, while the specific product ingredients have been specified for the purpose of construction of the preferred embodiment, it is clear that similar products and products by alternative manufacturers could be substituted. Therefore, the spirit and scope of the appended claims should not be limited to the description of the preferred versions disclosed.

What is claimed is:

1. A pipeline pig for scraping a buildup from an interior surface of a pipeline, the pipeline pig comprising:

(A) a bidirectional body having opposed bluntly shaped forward and backward facing noses, and having a cylindrical middle portion adapted to provide surface area to seal against the interior surface of the pipeline, the bidirectional body comprising:

(a) an elastic core, formed from a mixture of resin and ISO; and (b) an external cover, encasing the elastic core, wherein the external cover is made of heat-treated urethane; and (B) a plurality of studs, each stud carried within a hole defined in the external cover, each hole sized for insertion of the stud only after inflation of the cover enlarges the hole, whereby the plurality of studs thereby form an abrasive surface usable to scrape the buildup from the interior surface of the pipeline, each stud comprising:

(a) a cylindrical casing, carried by the external cover, made of a metal selected from the group consisting of aluminum, iron, an alloy containing aluminum and an alloy containing iron; and (b) a rod, extending from the cylindrical casing, the rod extending from a surface of the external cover approximately 1/16 inch, the rod made of a metal selected from the group consisting of iron carbide and tungsten carbide.

* * * * *